US007126563B2

(12) United States Patent
Lin et al.

(10) Patent No.: US 7,126,563 B2
(45) Date of Patent: Oct. 24, 2006

(54) BRIGHTNESS CORRECTION APPARATUS AND METHOD FOR PLASMA DISPLAY

(75) Inventors: Chun-Hsu Lin, Taipei Hsien (TW); Hsu-Pin Kao, Taoyuan Hsien (TW); Yi-Chia Shan, Taoyuan Hsien (TW); Kuang-Lang Chen, Taoyaun Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 457 days.

(21) Appl. No.: 10/064,527

(22) Filed: Jul. 24, 2002

(65) Prior Publication Data

US 2003/0231148 A1 Dec. 18, 2003

(51) Int. Cl.
*G09G 3/28* (2006.01)

(52) U.S. Cl. ..... 345/63; 345/690; 345/204; 315/169.4

(58) Field of Classification Search ..... 345/60–72, 345/204, 205, 207, 690; 346/60–69, 205, 346/207; 315/169.4; 348/797–799; 313/484
See application file for complete search history.

(56) References Cited

U.S. PATENT DOCUMENTS 4,709,346 A * 11/1987 Henlin ..... 708/702
5,943,032 A 8/1999 Nagaoka et al. ..... 345/63
6,088,009 A 7/2000 Moon ..... 345/60
6,340,961 B1 * 1/2002 Tanaka et al. ..... 345/63
6,359,389 B1 * 3/2002 Medina et al. ..... 315/169.1
6,646,625 B1 * 11/2003 Shigeta et al. ..... 345/63
6,774,873 B1 * 8/2004 Hsu et al. ..... 345/60
2002/0135595 A1 * 9/2002 Morita et al. ..... 345/589
2002/0175922 A1 * 11/2002 Koo et al. ..... 345/589

FOREIGN PATENT DOCUMENTS

JP 09-006282 * 1/1997

OTHER PUBLICATIONS

Grossman et al., Advanced Engineering Mathematics (New York: Harper & Row, 1988), p. 59.*

* cited by examiner

*Primary Examiner*—Lun-yi Lao
(74) *Attorney, Agent, or Firm*—Jianq Chyun IP Office

(57) ABSTRACT

Brightness correction apparatus and method for a plasma display, where the non-linear relationship between the gray scale and the brightness of the plasma display is considered. The brightness error is measured to build up a brightness error table. When the gray scale data of the currently displaying pixel is received, the brightness error diffusion method is applied. The weighted display brightness error of the neighboring pixel is incorporated for calculation to obtain an optimal display result. When the modified output gray scale data is derived by calculation, the brightness error table is looked up, and the display brightness error of the currently displaying pixel is thus saved to provide modification calculation for other pixels.

9 Claims, 5 Drawing Sheets

| | | | | | | | | | |
|---|---|---|---|---|---|---|---|---|---|
| ••• | | | A | B | C | D | E | | ••• |
| ••• | | | F | g | H | I | J | | ••• |
| ••• | | | K | L | O | P | Q | | ••• |

BRIGHTNESS CORRECTION APPARATUS AND METHOD FOR PLASMA DISPLAY

BACKGROUND OF INVENTION

1. Field of the Invention

The invention relates in general to a plasma display, and more particularly, to a brightness correction apparatus and method of a plasma display.

2. Description of Related Art

Generally, display apparatus can be classified into two major types. One is the display using the cathode ray tube (CRT), and the other is the flat panel display. Being lighter and thinner than the cathode ray tube display, and having a display image that is neither distorted nor interfered by a magnetic field, the flat panel display has gradually replaced the conventional cathode ray tube display to become the user favorite.

Commonly seen flat panel displays in the market include the liquid crystal display (LCD) and plasma display panel (PDP). The plasma display panel, which can be fabricated with a large display area, is specifically applicable for certain events and locations. In the discharge driving circuit of the plasma display, a field is typically divided into several sub-fields, while each sub-field has a specific number of sustain pulses. The display for different gray scale inputs is then achieved by a different allocation combination for each sub-field.

Referring to FIG. 1, a field of a plasma display is divided into several sub-fields. FIG. 1 shows an example of dividing a field into 8 sub-fields SF0 to SF7, and each them includes a constant address period 10 and a different sustain period 20 according to various numbers of sustain pulses. The more the sustain pulses are, the longer the sustain period 20 lasts. Assuming that 8 bits are used to represent the gray scale of the plasma display, there are 256 gray scales, 0–255, to be represented. Assuming that the number of the sustain pulses of the sub-field SF0 is 5, and the number of the sustain pulses SF1 to SF7 are 10, 20, 40, 80, 160, 320 and 640, respectively, the sub-fields SF1 to SF8 represents the gray scales 2, 4, 7, 13, 26, 46, 68 and 90, respectively. Other gray scales can be assembled by allocations of different sub-fields. For example, the gray scale 5 can be obtained by the combination of the sub-fields SF0 and SF2, and the gray scale 160 can be represented by the combination of the sub-fields SF5 and SF7. Accordingly, different gray scale data corresponding to the sustain pulse numbers further correspond to the display brightness of the display pixels.

However, due to factors such as discharging features or luminescence properties of fluorescent objects, a linear relationship between the actual display brightness and the sustain pulse number cannot exist. Normally, as shown in FIG. 2, the larger the sustain pulse number, the large the deviation is. Therefore, a brightness error between the ideal display brightness and the actual display brightness of the gray scale data occurs. To correct such brightness errors, U.S. Pat. No. 5,943,032 issued to Fujitsu Corp. proposed a method to adjust the sustain pulse number, and U.S. Pat. No. 6,088,009 issued to LG Corp. disclosed a method for adding a pseudo pulse to obtain a simple linear relationship between the gray scale and the brightness. However, as the adjustment is applied to the sustain pulse number for each sub-field only instead of adjusting each gray scale, the effect is still limited.

SUMMARY OF INVENTION

The present invention provides brightness correction apparatus and method of a plasma display allowing an enhanced display effect between the gray scale and picture brightness of a plasma display.

In the brightness correction apparatus provided by the present invention, the brightness error between ideal display brightness and actual display brightness for each gray scale data of the plasma display has been established as a reference for the circuit thereof in advance. The brightness correction apparatus comprises an inverse y conversion lookup unit, an error diffusion unit and a gray scale allocation lookup unit. The inverse y conversion lookup table is used to receive an input signal and convert the input signal into a first gray scale data to be output according to the inverse y conversion rule. The error diffusion unit is coupled to the inverse y conversion lookup unit to receive the first gray scale data. Further, a second gray scale data is output by modifying the first gray scale data with consideration of the display brightness error of the neighboring pixel of the currently displaying pixel. The brightness error of the second gray scale data is looked up and recorded as the brightness error for the currently displaying pixel. The gray scale allocation lookup unit is coupled to the error diffusion unit to receive the integral portion of the second gray scale data, and to obtain the desired output gray scale allocation by looking up a gray scale allocation table.

In one embodiment of the present invention, the error diffusion unit of the brightness correction apparatus of the plasma display includes an adder, a brightness error lookup circuit, and a weighted error supply circuit. The adder is used to receive the first gray scale data, and to sum up the first gray scale data and the weighted display brightness error of the neighboring pixel of the currently displaying pixel as the second gray scale data to be output. The brightness error lookup circuit is coupled to the adder to receive the integral portion of the second gray scale data, and to look up the brightness error table to obtain the brightness error of the currently displaying pixel. The weighted error supply circuit is coupled to the adder and the brightness error lookup circuit to save the brightness error received from the brightness error lookup circuit as the display brightness error of the currently displaying pixel. The display brightness error of the neighboring pixel of the currently displaying pixel is weighted to obtain the weighted display brightness error required by the adder.

In another embodiment of the present invention, the error diffusion unit of the brightness correction apparatus of the plasma display comprises a first adder, a brightness error lookup circuit, a second adder, and a weighted error supply circuit. The first adder is used to receive the first gray scale data, and to sum up the first gray scale data and the weighted display brightness error of the neighboring pixel of the currently displaying pixel as the second gray scale data to be output. The brightness error lookup circuit is coupled to the first adder to receive the integral portion of the second gray scale data, and to look up the brightness error table to obtain the brightness error of the currently displaying pixel. The second adder is coupled to the first adder and the brightness error lookup circuit to receive the decimal portion of the second gray scale data and the brightness error of the currently displaying pixel, so as to sum up the decimal portion of the second gray scale data and the brightness error as the display brightness error of the currently displaying pixel to be output. The weighted error supply circuit is coupled to the first adder and the second adder to save the display brightness errors of the neighboring pixel and the currently displaying pixel. The display brightness error of the neighboring pixel of the currently displaying pixel is weighted to obtain the weighted display brightness error required by the first adder.

The present invention further provides a brightness correction apparatus for a plasma display of which ideal display brightness and actual display brightness for each gray scale has been established. The brightness correction apparatus comprises an inverse y conversion lookup unit, an error diffusion unit, an integer gray scale lookup unit and a gray scale allocation lookup unit. The inverse y conversion lookup unit is used to receive an input signal, and according to the inverse y conversion rule, to convert the input signal into a first gray scale data to be output. The error diffusion unit is coupled to the inverse y conversion unit to receive the first gray scale data, and to output a second gray scale data derived by modifying the first gray scale data with consideration of the display brightness error of the neighboring pixel of the currently displaying pixel. Further, the brightness error of the second gray scale data is looked up and recorded as the display brightness error of the currently displaying pixel after being modified. The integer gray scale lookup unit is coupled to the error diffusion unit to receive the integral portion of the second gray scale data, and to obtain a third gray scale data by looking up the integer gray scale table. The gray scale allocation unit is coupled to the integer gray scale lookup unit to receive the third gray scale data, and to look up the gray scale allocation table to obtain the sustain pulse number of the currently displaying pixel to be output.

In the third embodiment of the present invention, the error diffusion unit of the brightness correction apparatus of the plasma display includes a first adder, a brightness error lookup circuit, a subtractor, a second adder, and a weighted error supply circuit. The first adder is used to receive the first gray scale data, and to sum up the first gray scale data and the weighted display brightness error of the neighboring pixel of the currently displaying pixel as the second gray scale data to be output. The brightness error lookup circuit is coupled to the first adder to receive the integral portion of the second gray scale data, and to look up the brightness error table to obtain the brightness error of the currently displaying pixel. The subtractor is coupled to the first adder and the integer gray scale lookup unit to receive the second gray scale data and a third gray scale data, and to obtain a gray scale error by subtracting the second gray scale with the third gray scale data. The second adder is coupled to the subtractor and the brightness error lookup circuit to receive the gray scale error and the brightness error of the currently displaying pixel, so as to sum up the gray scale error and the brightness error into a display brightness error to be output. The weighted error supply circuit is coupled to the first adder and the second adder to save the display brightness errors of the neighboring pixel and the currently displaying pixel. The display brightness error of the neighboring pixel of the currently displaying pixel is weighted to obtain the weighted display brightness error required by the first adder.

In the above embodiments, the brightness error table includes a lookup table for integral portion G and brightness error E of the gray scale data. Assuming that the actual measured gray scale and brightness is represented by a function $B_0(G)$, and the ideal gray scale and brightness has the relationship of function B(G), preferably, the calculation formula for establishing the brightness error table is $E=[(B(G)-B_0(G))/B_0(G)]*G$. If the input signal is S, and the first gray scale data is G1, it is preferable that $G1=(S/255)^{2.2}*255$ for the inverse y conversion rule with an NTSC input signal.

In addition, the present invention further provides a brightness correction method for a plasma display comprising the following steps. A brightness error between the ideal display brightness and the actual display brightness for each gray scale data is measured to establish a brightness table. When the first gray scale data of the currently displaying pixel is received, the first gray scale data is added with a value of the display brightness error of the neighboring pixel of the currently displayed pixel into a second gray scale data to be output. The brightness error table is looked up to obtain the brightness error of the second gray scale data. The brightness error of the second gray scale data is recorded as the display brightness error of the currently displaying pixel. Preferably, the recorded brightness error includes the decimal of the second gray scale data.

It is known from the above that the present invention provides a brightness correction apparatus and method for a plasma display. Because the brightness error diffusion has weighted and modified the display brightness error of the neighboring pixel of each of the currently displaying pixels, a spatial uniformity results, and a better picture brightness display effect is obtained.

BRIEF DESCRIPTION OF DRAWINGS

These, as well as other features of the present invention, will become more apparent upon reference to the drawings wherein.

DETAILED DESCRIPTION

Figure 1:
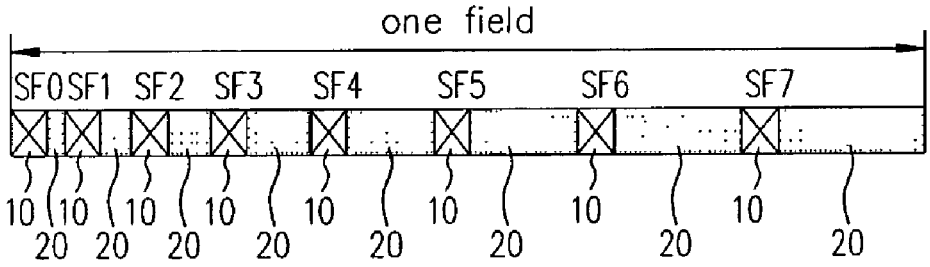
FIG. 1 is a schematic drawing of a field of a plasma display divided into several sub-fields.
Figure 2:
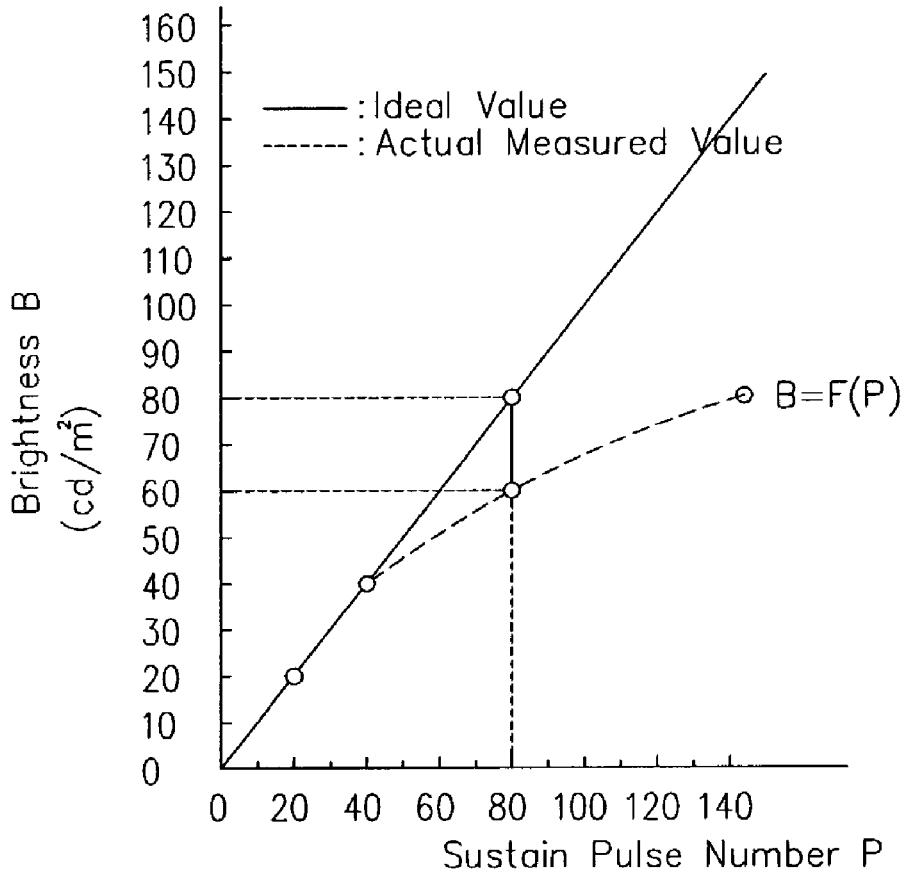
FIG. 2 schematically shows the relationship between the sustain pulse number and the brightness of a plasma display.

Referring to the relationship between sustain pulse and brightness as shown in FIG. 2, due to the discharging features and brightness properties of fluorescent objects, the sustain pulse and the brightness of a plasma display are not in a simple linear relationship. Consequently, the fidelity of the displayed picture is lost due to the brightness error between the gray scale and the brightness. To resolve such problems, before actually outputting the gray scale data, the brightness error has to be considered and offset. Therefore, establishing a brightness error table for mutually mapping the gray scale data and the brightness error by measuring the ideal display brightness and the actual display brightness for each gray scale of the plasma display in advance is necessary.

Assuming that the relationship is shown in FIG. 2, of which the abscissa indicates the sustain pulse number, as described above, by corresponding the gray scale 1 to 20 sustain pulses, the abscissa of FIG. 2 corresponds to the gray scale 0 to 7. FIG. 2 only illustrates gray scales 0 to 7.

Although other gray scales are not shown, they can be measured and illustrated in a similar manner. The ideal value curve in FIG. 2 indicates the desired relationship between the gray scale and the brightness. If the gray scale is represented by G, the brightness function is represented by B(G). Although a linear function is targeted here, people of ordinary skill in the art can use other non-linear functions according to specific applications. The actual measured curve in FIG. 2 indicates the relationship between the actual measured gray scale and the brightness, which is represented by function $B_0(G)$. A function of brightness error E for these two functions is established as:$E=F(B(G)-B_0(G))$, while the function used in the current embodiment is:$E=[(B(G)-B_0(G))/B_0(G)]$ *Glt is appreciated that this is not to limit the present invention, while people skilled in the art may make modifications according to specific requirements. In FIG. 2, when the sustain pulse number is 80 for the gray scale 4, the brightness error E=[(80−600/60]*4=4/3. Accordingly, the brightness error table with the gray scale and the brightness error mutually mapping each other is established.

Figure 3:
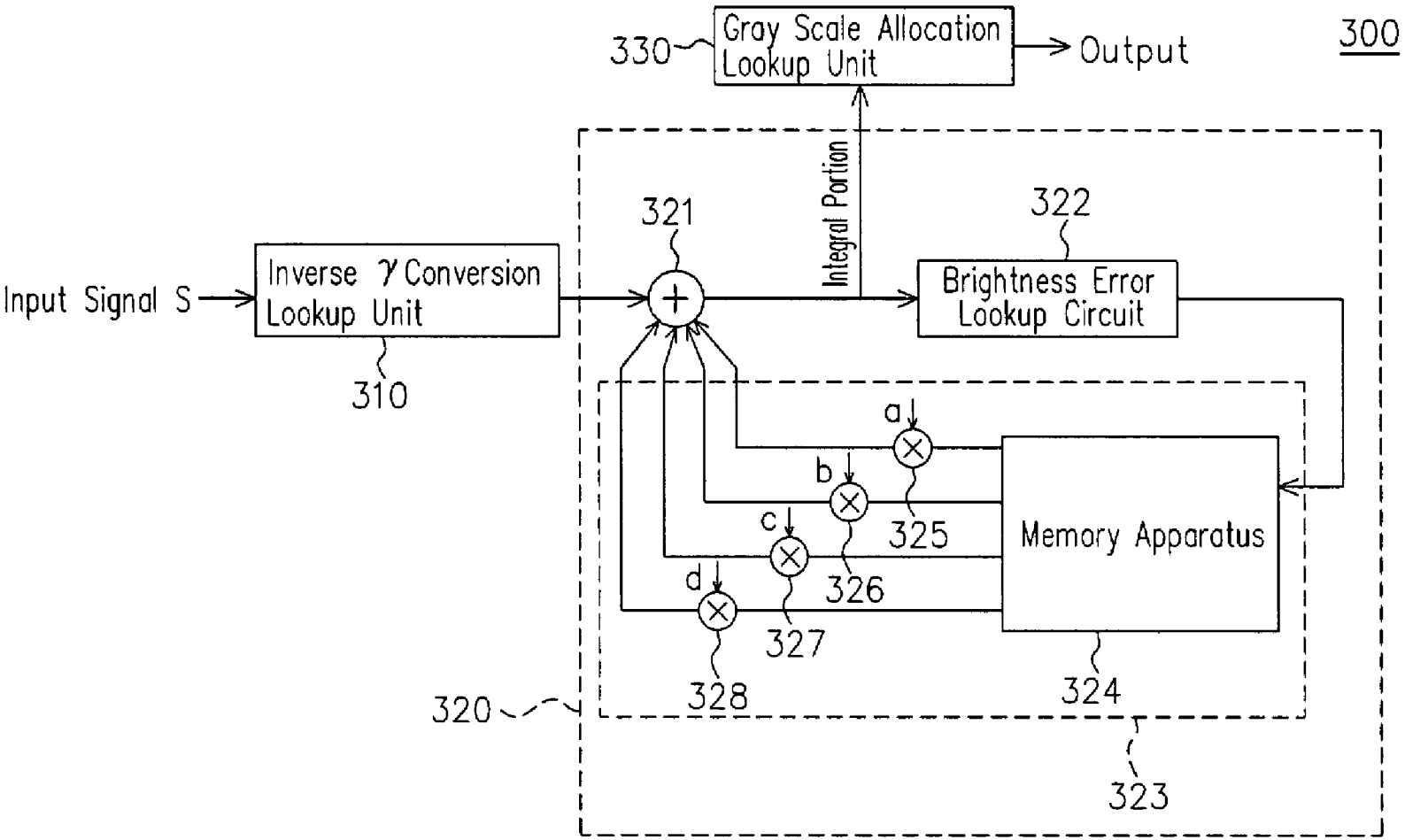
FIG. 3 shows a brightness correction apparatus in the first embodiment of the present invention.

Referring to FIG. 3, an embodiment of a brightness correction apparatus for a plasma display according to the present invention is illustrated. The brightness correction apparatus 300 of the plasma display includes an inverse y conversion lookup unit 310, a gray scale allocation lookup unit 330, and an error diffusion unit 320 which further comprises an adder 321, a brightness error lookup circuit 322 and a weighted error supply circuit 323.

The inverse γ conversion lookup unit 310 is used to receive an input signal S, and converts the input signal S into a first gray scale data G1 to be output according to inverse γ conversion rule. According to color display principle, the input signal S includes a red, green, or blue input signal. Using an NTSC signal as an example, the inverse γ conversion rule is $G1=(S/255)^{2.2}*255$.

The adder 321 is used to receive the first gray scale data G1, and to obtain a second gray scale data by summing the first gray scale data G1 and a weighted display brightness error of a neighboring pixel of a currently displaying pixel. The objective of such calculation is to consider the display brightness error of the neighboring pixel of the currently displaying pixel, and to offset by brightness error diffusion, allowing a picture closer to the ideal value.

Figures 6, 7:
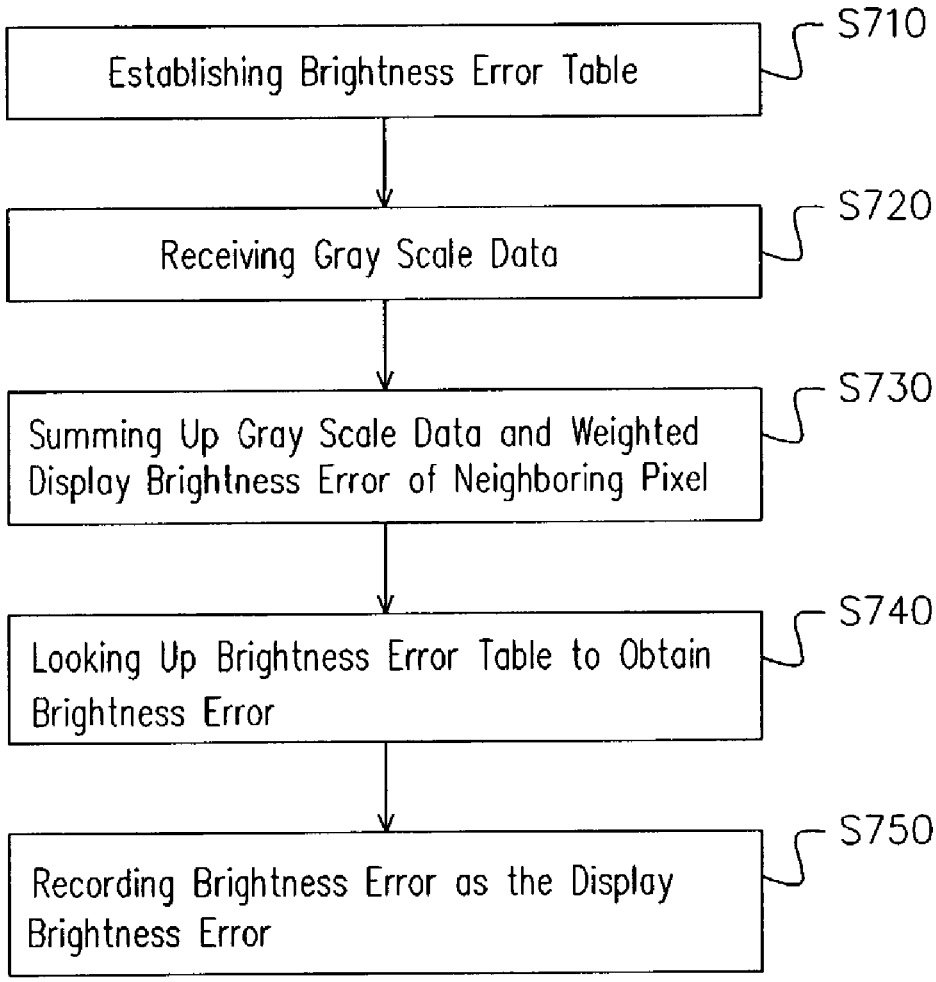
FIG. 6 shows the schematic arrangement of the pixels of the plasma display.
FIG. 7 shows the process flow of a brightness correction method of a plasma display according to the present invention.

The brightness error lookup circuit 322 is coupled to the adder 321 to receive the integral portion of the second gray scale data, and to look up the brightness error table to obtain the brightness error of the currently displaying pixel. For example, in the brightness error table established above, the second gray scale data of the gray scale 4 is input, and the corresponding brightness error is ¾. The brightness error ¾ is input to a memory apparatus 324 of the weighted error supply circuit 323 to be stored as the display brightness error of the currently displaying pixel. According to the principle, the memory apparatus 324 will store the display brightness errors of the neighboring pixels of the previously sequentially displayed currently displaying pixels. The display brightness errors are weighted to obtain the weighted display brightness error required by the adder 321. For this embodiment, the display brightness error of the four neighboring pixels of the currently displaying pixel are weighted with weighting value a, b, c, d via the multipliers 326, 327, 328 and 329, respectively, where a+b+c+d is preferably equal to 1. The method to obtain the neighboring pixels is shown in FIG. 6. When the currently displaying pixel is g, the pixels A, B, C and F are extracted. When P is the currently displaying pixel, the pixels H, I, J and O are weighted. Although this embodiment uses four neighboring pixels calculated by four multipliers to obtain the weighted display brightness errors, it is appreciated that amount of the neighboring pixels and the method for obtaining them are variable.

The gray scale allocation lookup unit 330 is coupled to the error diffusion unit 320 to receive the integral portion of the second gray scale data, and to look up a gray scale allocation table to obtain the sustain pulse number of the currently displaying pixel to be output.

Figure 4:
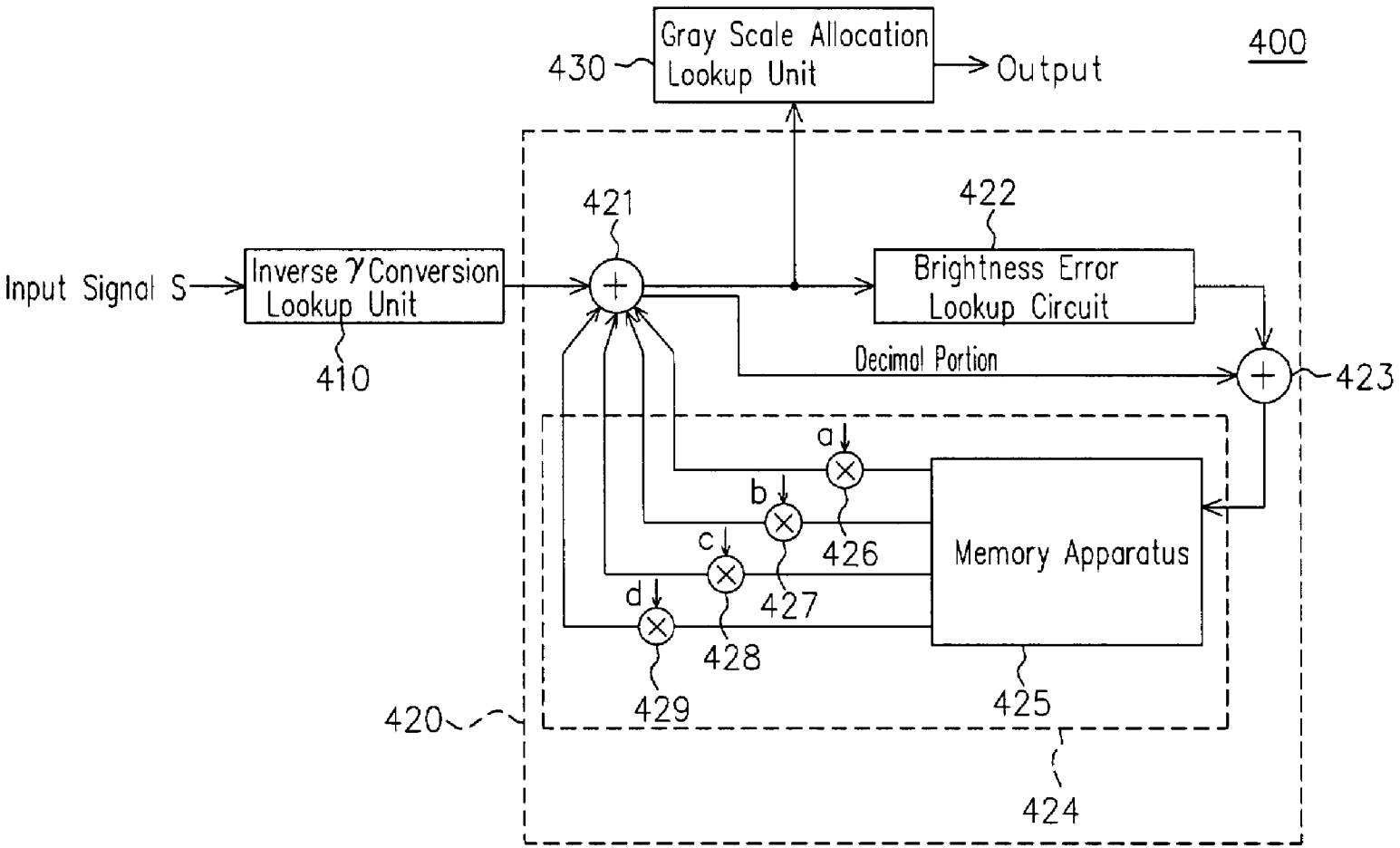
FIG. 4 shows a brightness correction apparatus in the second embodiment of the present invention.

Referring to FIG. 4, a second embodiment of a brightness correction apparatus for a plasma display according to the present invention is shown. Similarly, the brightness correction apparatus 400 of the plasma display includes an inverse γ conversion lookup unit 410, a gray scale allocation lookup unit 430 and an error diffusion unit 420. The difference is that the error diffusion unit 420 includes a first adder 421, a brightness error lookup circuit 422, a second adder 423, and a weighted error supply circuit 424. The operation principles of the inverse γ conversion lookup unit 410, the gray scale allocation lookup unit 430, the first adder 421, the brightness error lookup circuit 422, and the weighted error supply circuit 424 including the multipliers 426, 427, 428, 429 and the memory apparatus 425 are similar to those described in the first embodiment. A detailed description is not given again. The major difference is the addition of the second adder 423, which is used to calculate the decimal error generated by the inverse γ conversion lookup unit 410. As such decimal error will be ignored by the gray scale allocation lookup unit 430, it is thus added into the calculation of brightness error before the brightness error is saved in the memory apparatus 425 as the display brightness error of the currently displaying pixel.

Figure 5:
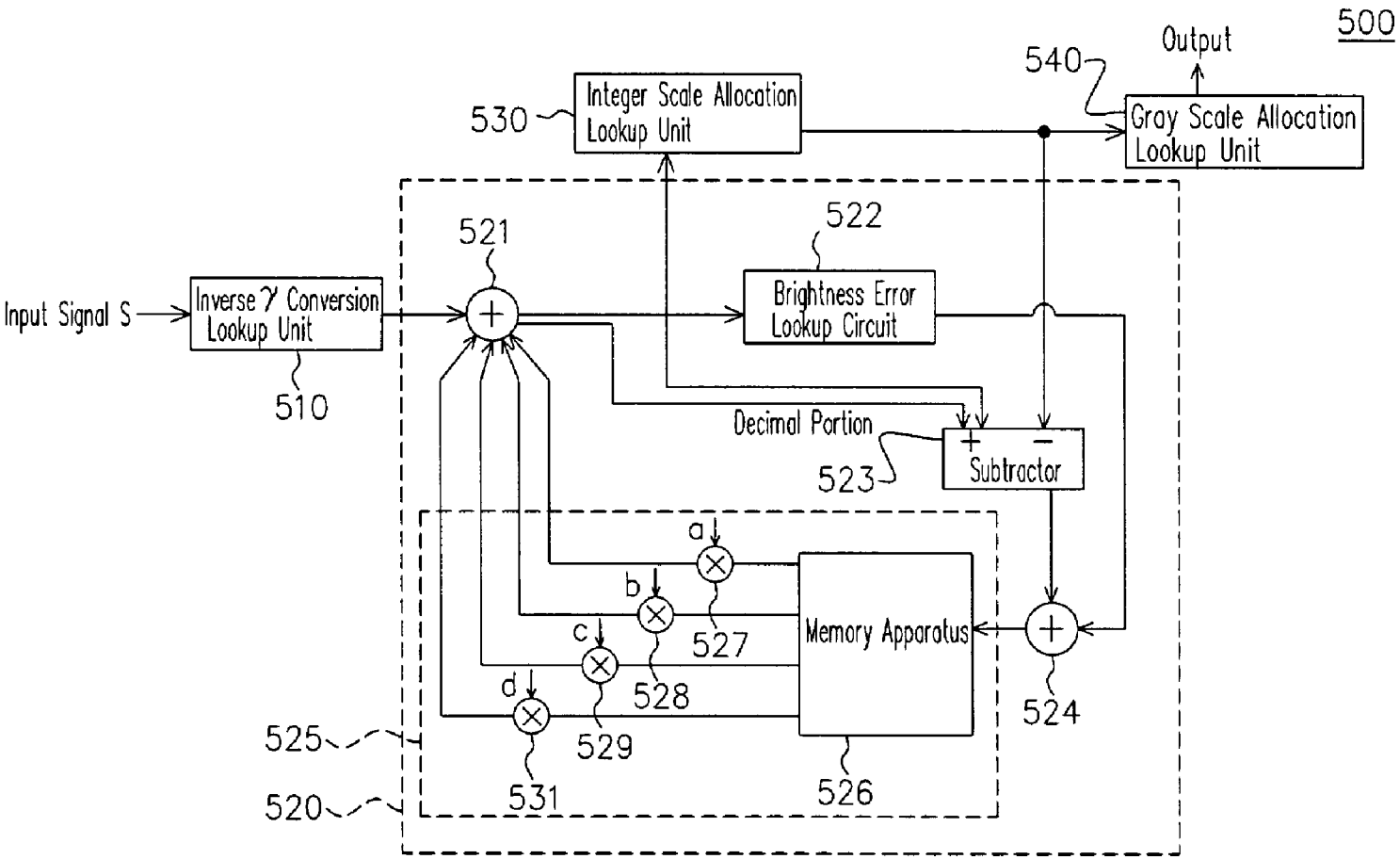
FIG. 5 shows a brightness correction apparatus in the third embodiment of the present invention.

FIG. 5 illustrates a brightness correction apparatus for a plasma display in the third embodiment of the present invention. As shown in FIG. 5, the brightness correction apparatus 500 includes an inverse γ conversion lookup unit 510, an integer gray scale lookup unit 530, a gray scale allocation unit 540 and an error diffusion unit 520. The principles of the inverse γ conversion lookup unit 510 and the gray scale allocation lookup unit 540 are the same as those in the previous embodiments. However, to resolve the problems of dynamic false contour, an additional integer gray scale lookup unit 530 is provided to use a gray scale input and output lookup table to replace the unwanted output gray scale by other gray scales. For example, when gray scales 45 and 46 are desired not to be output, the gray scale output of gray scale 44 or 47 generated by the lookup table can be used to replace the input gray scales 45, 46.

To comply with such circuit variation, the error diffusion unit 520 is modified to include a first adder 521, a brightness error lookup circuit 522, a subtractor 523, a second adder 524, and a weighted error supply circuit 525 which includes multipliers 527, 528, 529, 531 and a memory apparatus 526. The first adder 521, the brightness error lookup circuit 522, the multipliers 527, 528, 529, 531 and the memory apparatus 526 are similar to those described in the previous embodiments. To simultaneously consider the decimal error generated by the inverse γ conversion lookup unit 510 and the integer error generated by the integer gray scale lookup unit 530, the subtractor 523 is used to calculate the gray scale error between the decimal error and the integer error. Before saving brightness error into the memory apparatus 526, the gray scale error is included by the second adder 524 for calculating the display brightness error of the currently displaying pixel to be stored. In addition, the integer gray scale lookup unit 530 may be integrated into the gray scale allocation lookup unit 540. For example, when gray scales 45 and 46 are not to be output, the gray scales 45 and 46 are mapped to gray scale 44 in the gray scale allocation table in the gray scale allocation lookup unit 540. Meanwhile, the brightness error table of the brightness error lookup circuit 522 must also comply with the brightness errors for adjusting the gray scales 45 and 46. Apart from the different gray scale allocation table and the brightness table, the combined circuit structure is similar to the first or second embodiment.

Accordingly, a brightness correction method of a plasma display is shown in FIG. 7, which includes the following steps. The brightness errors of the ideal display brightness and actual display brightness for each gray scale are measured to establish a brightness error table (S710). When the first gray scale data of the currently displaying pixel is received, the weighted value of the display brightness error of the neighboring pixels of the currently displaying pixel are added to the first gray scale data as a second gray scale data to be output (S730). According to the second gray scale data, the brightness error table is looked up to obtain the brightness error thereof (S740). The brightness error of the second gray scale data is recorded as the display brightness error of the currently displaying pixel (S750). In this brightness correction method, the decimal portion of the second gray scale data is preferably combined with the brightness error obtained in step S740 for calculation and recorded as the display brightness error.

According to the above, the present invention includes at least the following advantages:

1. As the brightness error between the ideal display brightness and the actual display brightness of the gray scale of the plasma display is considered and compensated by the brightness error diffusion, better picture quality and display effect are obtained.

2. The gray scales unwanted for output can be converted into other gray scales for output and compensated by brightness error diffusion.

Other embodiments of the invention will appear to those skilled in the art from consideration of the specification and practice of the invention disclosed herein. It is intended that the specification and examples are to be considered as exemplary only, with a true scope and spirit of the invention being indicated by the following claims.

The invention claimed is:

1. A brightness correction apparatus of a plasma display, of which a brightness error of ideal display brightness and actual display brightness for each gray scale has been established, the apparatus comprising;

an inverse γ conversion lookup unit, to receive an input signal of a currently displaying pixel, and to convert the input signal into a first gray scale data to be output according to an inverse γ conversion rule;

an error diffusion unit, coupled to the inverse γ conversion lookup unit to receive the first gray scale data, and to modify the first gray scale data into a second gray scale data recorded as a display brightness error of the currently displaying pixel by considering a display brightness error of a neighboring pixel of the currently displaying pixel; and a gray scale lookup unit, coupled to the error diffusion unit to receive an integral portion of the second gray scale data, and to look up a gray scale allocation table to obtain a sustain pulse number of the currently displaying pixel, wherein the error diffusion unit further comprises;

an adder, to receive the first gray scale data to obtain the second gray scale data by summing the first gray scale data and a weighted display brightness error of the neighboring pixel;

a brightness error lookup circuit, coupled to the adder to receive the integral portion of the second gray scale data, and to look up a brightness error table to obtain the brightness error of the currently displaying pixel, wherein the brightness error table includes a lookup table for the integral portion of the second gray scale data G and the brightness error E, and the brightness error table is established by an actual measured gray scale function of brightness $B_0(G)$ and an ideal gray scale function of brightness B(G) as $E=[(B(G)-B(G_0))/B_0(G)]*G$; and a weighted error supply circuit coupled to the adder and the brightness error lookup circuit to save the brightness errors of the sequentially displayed currently displaying pixel and the neighboring pixel as the display brightness errors thereof, and to weight the display brightness error of the neighboring pixel to obtain the weighted display brightness error required by the adder.

2. The apparatus according to claim 1, wherein the gray scale allocation includes a lookup table for the table integral portion of the second gray scale data and the sustain pulse number, and the integral portion of some different second gray scale data may correspond to the same sustain pulse number, while the brightness table must be modified to comply with the corresponding brightness error.

3. A brightness correction apparatus of a plasma display, of which a brightness error of ideal display brightness and actual display brightness for each gray scale has been established, the apparatus comprising:

an inverse γ conversion lookup unit to receive an input siunal of a currently displaying pixel, and to convert the input signal into a first gray scale data to be output according to an inverse γ conversion rule;

an error diffusion unit coupled to the inverse γ conversion lookup unit to receive the first gray scale data, and to modify the first gray scale data into a second gray scale data recorded as a display brightness error of the currently displaying pixel by considering a display brightness error of a neighboring pixel of the currently displaying pixel; and a gray scale lookup unit, coupled to the error diffusion unit to receive an integral portion of the second gray scale data, and to look up a gray scale allocation table to obtain a sustain pulse number of the currently displaying pixel, wherein the error diffusion unit comprises:

a first adder, to receive the first gray scale data to obtain the second gray scale data by summing the first gray scale data and a weighted display brightness error of the neighboring pixel;

a brightness error lookup circuit, coupled to the first adder to receive the integral portion of the second gray scale data, and to look up a brightness error table to obtain the brightness error of the currently displaying pixel;

a second adder, coupled to the first adder and the brightness error lookup circuit to receive a decimal portion of the second gray scale data and the brightness error of the currently displaying pixel, and to obtain the sum of the integral and decimal portions of the currently displaying pixel as the display brightness error to be output of the currently displaying pixel; and a weighted error supply circuit, coupled to the first adder and the second adder to save the display brightness errors of the currently displaying pixel and the neighboring pixel, and to weight the display brightness error of the neighboring pixel to obtain the weighted display brightness error required by the adder.

4. The apparatus according to claim 3, wherein the brightness error table includes a lookup table for the integral portion of the second gray scale data G and the brightness error E, and the brightness error table is established by an actual measured gray scale function of brightness $B_0(G)$ and an ideal gray scale function of brightness B(G) as:

$$E=[(B(G)-B(G_0))/B_0(G)]*G.$$

5. The apparatus according to claim 4, wherein the gray scale allocation includes a lookup table for the table integral portion of the second gray scale data and the sustain pulse number, and the integral portion of some different second gray scale data may correspond to the same sustain pulse number, while the brightness table must be modified to comply with the corresponding brightness error.

6. A brightness correction apparatus of a plasma display, of which a brightness error of ideal display brightness and actual display brightness for each gray scale has been established, the apparatus comprising:

an inverse γ conversion lookup unit, to receive an input signal of a currently displaying pixel, and to convert the input signal into a first gray scale data to be output according to an inverse γ conversion rule;

an error diffusion unit, coupled to the inverse γ conversion lookup unit to receive the first gray scale data, and to modify the first gray scale data into a second gray scale data recorded as a display brightness error of the currently displaying pixel by considering a display brightness error of a neighboring pixel of the currently displaying pixel; and an integer gray scale lookup unit, coupled to the error diffusion unit to receive an integral portion of the second gray scale date, and to look up an integer gray scale table to obtain a third gray scale data; and a gray scale allocation lookup unit, coupled to the integer gray scale lookup unit to receive the third gray scale data, and to look up a gray scale allocation table to obtain a sustain pulse number of the currently displaying pixel to be output, wherein the error diffusion unit comprises:

a first adder, to receive the first gray scale data and to obtain the second gray scale data by summing the first gray scale data and a weighted display brightness error of the neighboring pixel;

a brightness error lookup circuit, coupled to the first adder to receive the integral portion of the second gray scale data, and to look up a brightness error table to obtain the brightness error of the currently displaying pixel;

a subtractor, coupled to the first adder and the integer gray scale lookup unit to receive the second and third gray scale data to obtain a gray scale error between the second and the third gray scale data;

a second adder, coupled to the subtractor and the brightness error lookup circuit to receive the gray scale error and the brightness error of the currently displaying pixel, and to obtain the display brightness error to be output by summing of the gray scale error and the brightness error of the currently displaying pixel; and a weighted error supply circuit, coupled to the first adder and the second adder to save the display brightness errors of the currently displaying pixel and the neighboring pixel, and to weight the display brightness error of the neighboring pixel to obtain the weighted display brightness error required by the adder.

7. The apparatus according to claim 6, wherein the brightness error table includes a lookup table for the integral portion of the second gray scale data G and the brightness error E, and the brightness error table is established by an actual measured gray scale function of brightness $B_0(G)$ and an ideal gray scale function of brightness B(G) as:

$$E=[(B(G)-B(G_0))/B_0(G)]*G.$$

8. A brightness correction method of a plasma display, comprising:

obtaining a brightness error for each gray scale by measuring ideal display brightness and actual display brightness thereof, so as to establish a brightness error table;

receiving a first gray scale data of a currently displaying pixel;

adding the first gray scale data to a weighted display brightness of a neighboring pixel of the currently displaying pixel as a second gray scale data;

looking up the brightness error table to obtain the brightness error of the second gray scale data; and recording the brightness error of the second gray scale data as the display brightness error of the currently displaying pixel, wherein the brightness error table includes a lookup table for the integral portion of the second gray scale data G and the brightness error E, and the brightness error table is established by an actual measured gray scale function of brightness $B_0(G)$ and an ideal gray scale function of brightness B(G) as $E=[(B(G)-B(G_0))/B_0(G)]*G$.

9. The method according to claim 8, wherein the step of recording the brightness error includes recording a decimal portion of the second gray scale data.

* * * * *